United States Patent [19]

Gustafsson

[11] Patent Number: 5,055,854

[45] Date of Patent: Oct. 8, 1991

[54] REFLECTOR FOR PARABOLIC ANTENNAE

[75] Inventor: Regis Gustafsson, Brosarp, Sweden

[73] Assignee: Sparbanken Syd, Ystad, Sweden

[21] Appl. No.: 204,320

[22] Filed: Jun. 9, 1988

[30] Foreign Application Priority Data

Jun. 30, 1987 [SE] Sweden ..... 8702699

[51] Int. Cl.[5] ..... H01Q 15/16

[52] U.S. Cl. ..... 343/912

[58] Field of Search ..... 343/840, 912, 781

[56] References Cited

U.S. PATENT DOCUMENTS

| | | | |
|---|---|---|---|
| 2,742,387 | 4/1956 | Giuliani | 343/912 |
| 3,150,030 | 9/1964 | Mondano | 343/912 |
| 4,495,503 | 1/1985 | Morman | 343/895 |
| 4,612,550 | 9/1986 | Brucker et al. | 343/756 |
| 4,789,868 | 12/1988 | Oono et al. | 343/912 |

*Primary Examiner*—Michael C. Wimer

*Attorney, Agent, or Firm*—Sughrue, Mion, Zinn, Macpeak & Seas

[57] ABSTRACT

The invention relates to a parabolic antenna reflector. The reflector is comprised of two electrically conducting metal layers (2, 4) which are separated by a dielectricum consisting, for instance, of polypropylene plastic. For the purpose of eliminating the edge currents which occur in the signal receiving and signal transmitting metal layer of the reflector, the reflector is constructed to form a capacitor, wherein the insulating layer (3) is given a thickness such that in conjunction with the dielectric constant of the selected insulating material the side lobes, created by the edge currents, are at least substantially eliminated.

3 Claims, 1 Drawing Sheet

REFLECTOR FOR PARABOLIC ANTENNAE

The present invention relates to a reflector for parabolic antennae manufactured from a laminate which comprises two layers of material which will conduct electricity readily, and an intermediate layer of plastics material of substantially uniform thickness and having low electrical conductivity.

Such antenna reflectors, which are used to receive satellite signals for example, have been found to retain their shape and are relatively cheap to produce. One serious drawback with reflectors of this kind, however, is that edge currents are induced in the radiation receiving and transmitting metal surface of the reflector, which results in the occurrence of undesirable radiation lobes.

Consequently, a main object of the invention is to provide a reflector in which these side lobes are essentially eliminated. This object is fulfilled by the reflector set forth in the following claims.

BRIEF DESCRIPTION OF THE DRAWINGS

The invention will now be described in more detail with reference to the accompanying drawing, in which.

DETAILED DESCRIPTION OF THE INVENTION

Figure 1:
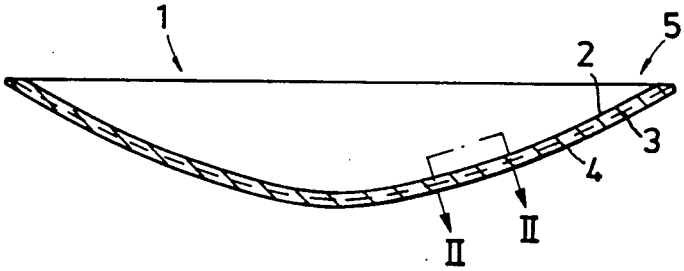
FIG. 1 is a schematic, central axial view of a reflector.
Figure 2:
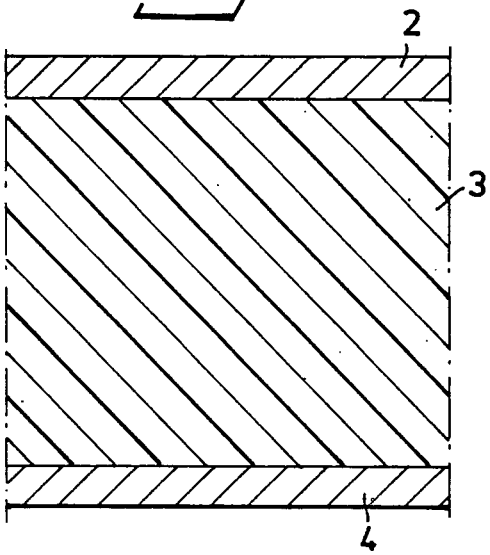
FIG. 2 is an enlarged detailed view taken on the line II—II in FIG. 1.

FIG. 1 is a sectional view of a parabolic reflector or mirror 1 taken on the axis thereof. The reflector is comprised of three layers 2, 3 and 4 which are firmly joined together, to form a laminated structure. This laminated structure will best be understood from FIG. 2. In the case of the illustrated embodiment the radiating or radiation receiving surface comprises an aluminum layer 2 which is joined with an electrically non-conductive, or at least essentially non-conductive layer 3 of plastics material, e.g. a layer of polypropylene, styrene or an electrically non-conductive material comparable therewith. An aluminum layer 4 is firmly connected to the undersurface of this plastics layer. It will be understood that the layers 2 and 4 need not necessarily consist of aluminum, but may be comprised of any type of metal that has good electrical conductivity, e.g. copper or silver.

Figure 3:
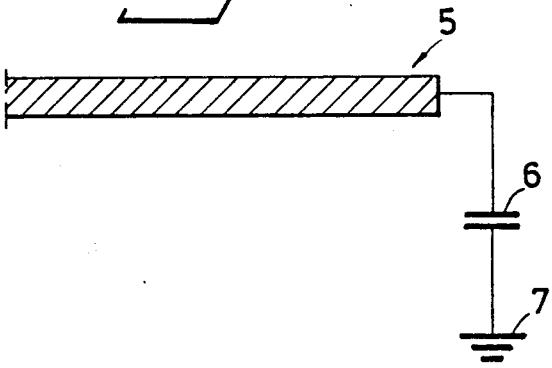
FIG. 3 illustrates an equivalent circuit diagram for the inventive reflector.

When the antenna incorporating the reflector 1 is in operation, so-called edge currents are generated around the rim or edge part 5 of the reflector, resulting in interference or poor reception due to the formation of undesirable lobes. In accordance with the invention, the whole of the insulating plastics layer 3 is dimensioned so that the whole of the reflector 1 forms a capacitor 6 (FIG. 3) having an impedance value near or equal to 0 in respect of earth 7 for the currents induced in the metal layer 2 at the operational frequency of the antenna, which may be 12 GHz for instance.

When, for instance, the layers 2 and 4 are composed from well-conducting metal foil or metal sheet and the intermediate plastics layer 3 is composed by polypropylene and has a thickness of 5 mm there is obtained a capacitor which possesses the following values.

The thickness of the metal layers is in practice of subordinate significance. The selected insulating material, polypropylene, has a dielectric constant $\epsilon_r = 2.25$.

According to the formula $$C = \frac{\epsilon \cdot A}{\delta}$$

where the C = capacitance expressed in F, $\delta$ = the thickness of the layer 3; $\epsilon = \epsilon_r \times \epsilon_o$, where $\epsilon_o = 8.854 \cdot 10^{12}$ F/m, and A = the area there will be obtained, provided that the parabolic reflector has a diameter of 0.9 m, an area A of 0.69 $m^2$, and therewith $$C = \frac{1.863 \cdot 10^{-11} \cdot 0.69}{0.005} = 2.57 \text{ nF},$$

at the given operational frequency an impedance of ~0 and a substantial elimination of the side lobes.

If, on the other hand, the insulating layer 3 is used as a bonding layer with a thickness, e.g. of 0.01 mm, the capacitance will be approximately 1300 nF, i.e. a substantial decrease of the impedance.

The insulating plastics layer is assumed to have an at least substantially uniform thickness.

Such a low impedance, which depends on the dielectric characteristic and thickness of the insulating layer 3 and the operational frequency has turned out to create a substantially complete elimination of the said undesirable radiation lobes. This unexpected effect cannot be fully explained but it could be that the induced currents are decoupled to earth, thus attenuating or eliminating the side lobes or that the capacitance possibly creates such a distribution or modifying of the edge currents that the edge currents are distributed in the metallic layer such that the side lobes are attenuated sufficiently to avoid any undesirable effects.

I claim:

1. A parabolic antenna reflector (1) which comprises a laminate formed from two layers (2, 4) of electrically well-conducting metal and an intermediate layer of plastics material of essentially uniform thickness end of low electrical conductivity, characterized in that the thickness and dielectric constant of the plastic layer are such that, at the operational frequency of the antenna, said reflector (1) forms a decoupling or by-pass capacitor (6) with a low impedance to earth (7) to attendantly reduce undesirable radiation side lobes.

2. An antenna reflector according to claim 1, wherein said two metal layers (2, 4) comprise at least one of aluminum, silver or cooper and said plastics layer comprises polypropylene.

3. An antenna reflector according to claim 2 for use with an operational frequency of approximately 12 GHz, further wherein said polypropylene layer has a thickness of 5 mm.

* * * * *